US006230540B1

(12) United States Patent
Wilch et al.

(10) Patent No.: US 6,230,540 B1
(45) Date of Patent: May 15, 2001

(54) METHOD AND APPARATUS FOR FORMING AN INTEGRAL BEARING SHOULDER IN A TUBULAR AXLE

(75) Inventors: John Wayne Wilch, Bluffton; Vipan Kumar Bhalla, Findlay, both of OH (US)

(73) Assignee: Meritor Heavy Vehicle Systems LLC, Troy, MI (US)

( * ) Notice: Subject to any disclaimer, the term of this patent is extended or adjusted under 35 U.S.C. 154(b) by 0 days.

(21) Appl. No.: 09/420,534

(22) Filed: Oct. 19, 1999

(51) Int. Cl.[7] ..... B21D 41/00

(52) U.S. Cl. ..... 72/370.1; 72/342.1; 72/342.96; 72/370.25; 72/260; 29/897.2

(58) Field of Search ..... 72/370.1, 370.11, 72/370.13, 370.23, 370.25, 342.1, 342.94, 342.96, 260; 29/897.2

(56) References Cited

U.S. PATENT DOCUMENTS

| | | | | |
|---|---|---|---|---|
| 3,668,918 | * | 6/1972 | Benteler et al. | 72/370.13 |
| 4,301,672 | | 11/1981 | Simon . | |
| 4,435,972 | | 3/1984 | Simon . | |
| 5,205,464 | | 4/1993 | Simon . | |
| 5,213,250 | | 5/1993 | Simon . | |
| 5,517,843 | * | 5/1996 | Winship | 72/342.1 |

FOREIGN PATENT DOCUMENTS

| | | | | |
|---|---|---|---|---|
| 640414 | * | 3/1995 | (EP) | 72/100 |
| 59-215221 | * | 12/1984 | (JP) | 72/342.1 |
| 61-279328 | * | 12/1986 | (JP) | 72/342.94 |
| 1375391 | * | 2/1988 | (SU) | 72/342.94 |

* cited by examiner

*Primary Examiner*—Ed Tolan
(74) *Attorney, Agent, or Firm*—Carlson, Gaskey & Olds, P.C.

(57) ABSTRACT

A tubular axle having a spindle and a bearing shoulder is formed directly into heat-treated tubing. The method generally includes a heating operation, and a two stage forming operation. The first operation is to induction heat a steel tubular axle blank to a temperature less than 1500 degrees Fahrenheit. The next operation includes forcing a preform die assembly onto the tubular blank to reduce a length of the blank to a second diameter while forming an intermediate section having a first and second ramped section. The final operation includes forcing an upset die assembly onto the end of the blank to form a gathered material section formed intermediate the first ramped section and the second ramped section. The second diameter provides a pre-machined diameter for the final axle spindle and the gathered material section provides a pre-machined area for the final integral bearing shoulder.

17 Claims, 2 Drawing Sheets

METHOD AND APPARATUS FOR FORMING AN INTEGRAL BEARING SHOULDER IN A TUBULAR AXLE

BACKGROUND OF THE INVENTION

The present invention relates to an axle for heavy vehicle applications, and more particularly to forming an integral bearing shoulder in a tubular axle.

As a part of the production of axles, a shoulder is required as a back-up for the bearings which are assembled to the axle. The bearing shoulder is a stepped-up section of the spindle and is typically formed intermediate the spindle and axle diameter. The bearing fits onto the spindle at each end of the axle and the shoulder supports the bearing.

There are several known methods to produce this shoulder. One method is to manufacture an axle from a solid bar of steel. The entire axle, spindle and shoulder are directly produced from the steel bar. Other methods manufacture the axle as a tube with spindles welded to each end. These spindles also have a shoulder forged into them to provide the bearing support.

Yet another method is to form the spindle onto the end of the tubing and weld a collar onto the formed spindle to produce the bearing shoulder. This has proven to be an effective method for the production of semi-trailer axles. However, a machined component and a welding operation are required. Although practical, this does increase the finished axle cost.

Attempts to form the shoulder directly from axle tubing have required the use of temperatures in excess of 2000 degrees Fahrenheit in a localized area. This temperature is above the transition temperature of steel which has previously not allowed the use of heat treated tubing. The non-heat treated tube must be subjected to a quench and temper operation after forming to provide a tube having the desired strength for an axle. This increases the manufacturing complexity and also increases the finished axle cost.

Accordingly, it is desirable to provide an economical method for forming a tubular axle having the bearing shoulder directly formed into the tubing.

SUMMARY OF THE INVENTION

The method according to the present invention provides a tubular axle having the bearing shoulder directly formed into heat-treated tubing. The method generally includes a heating operation, a preform operation and an upset forming operation.

The first operation in forming the tubular axle is the heating of a length of the tubular blank. The first length is heated to a temperature less than 1500 degrees Fahrenheit, and preferably to a temperature of approximately 1250 degrees Fahrenheit. By heating the tubular blank to a temperature less than the transformation temperature of steel (which occurs at approximately 1500 degrees Fahrenheit) the present invention allows the use of heat treated steel without loss of the heat treated properties.

The next operation includes forcing a preform die assembly onto the end of the tubular blank by a machine such as a double-ended hydraulic press having a two-stage die holder. Preferably, the tubular blank is held stationary as the machine simultaneously forces the die assemblies onto both ends of the tubular blank. By using a lubricant and by performing a two stage forming operation, a mandrel is not required to be inserted into the tubular axle blank during the forming. This eliminates the possibility of a mandrel being wedged into the tubular blank and the resultant scrap.

The preform die assembly is forced onto the tubular blank, and the original diameter is reduced to a second diameter. As the preform die assembly is forced further onto the tubular blank an intermediate section is formed between the original diameter and the second diameter. The intermediate section is preferably formed as a first ramped section and a second ramped section.

The final operation includes forcing an upset die assembly onto the end of the tubular blank to form the final bearing shoulder and spindle configuration. The upset die assembly forms a gathered material section that is preferably a substantially stepped section formed intermediate the first ramped section and the second ramped section.

The second diameter provides a pre-machined diameter for the final axle spindle and the gathered material area provides a pre-machined area for the integral bearing shoulder. The axle of the present invention does not require a machined collar to be welded onto the spindle which results in a manufacturing cost savings. Further, a fatigue life improvement in the axle is obtained as the high stress area at the heat effected zone of the collar weld is eliminated.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
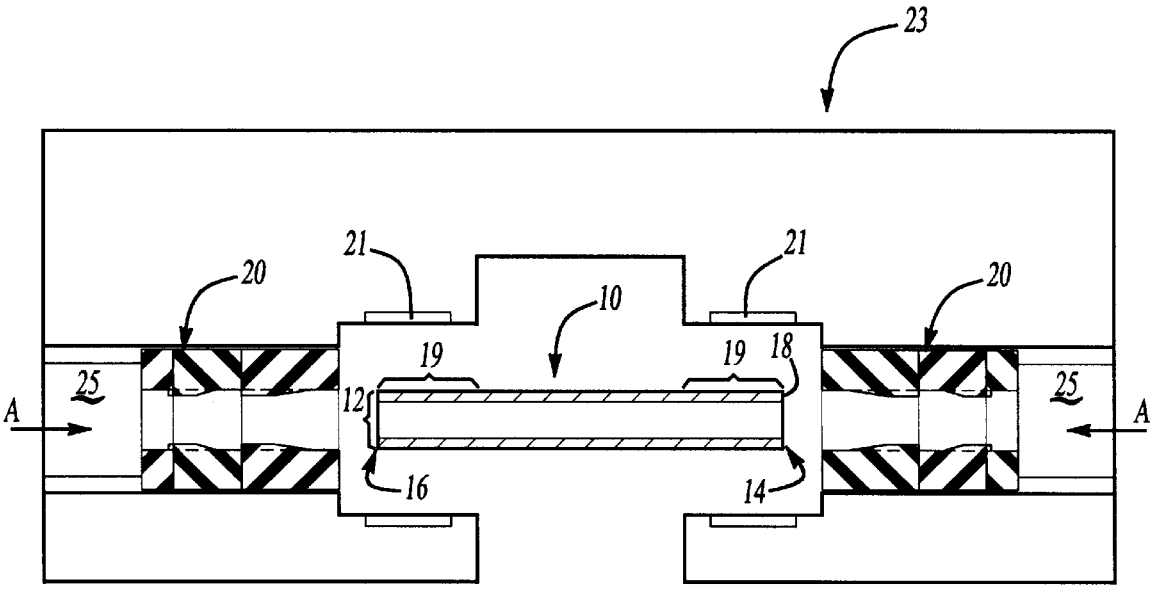
FIG. 1 is a general sectional view of a tubular axle blank and a machine for forming a tubular axle according to the present invention.

FIG. 1 illustrates a section of a tubular blank 10 prior to forming into a tubular axle. The tubular blank is preferably a heat treated steel tube. The tubular blank 10 has an original diameter 12, a first end 14, an opposite end 16 and a wall thickness 18. Although the tubular blank 10 has a uniform wall thickness along the entire length, it should be realized that any member having substantially tubular ends could benefit from the present invention.

The first operation in forming the tubular axle is the heating of a length 19 of the tubular blank 10. A heater (shown schematically at 21), such as an induction heater is preferably included within a machine (shown schematically at 23), such as a double-ended hydraulic press. Preferably, the tubular blank 10 is held stationary as the machine 23 simultaneously forces a die assembly 20 onto both ends of the tubular blank 10 with a hydraulic ram 25 or the like in the direction of arrows A.

Figure 2:
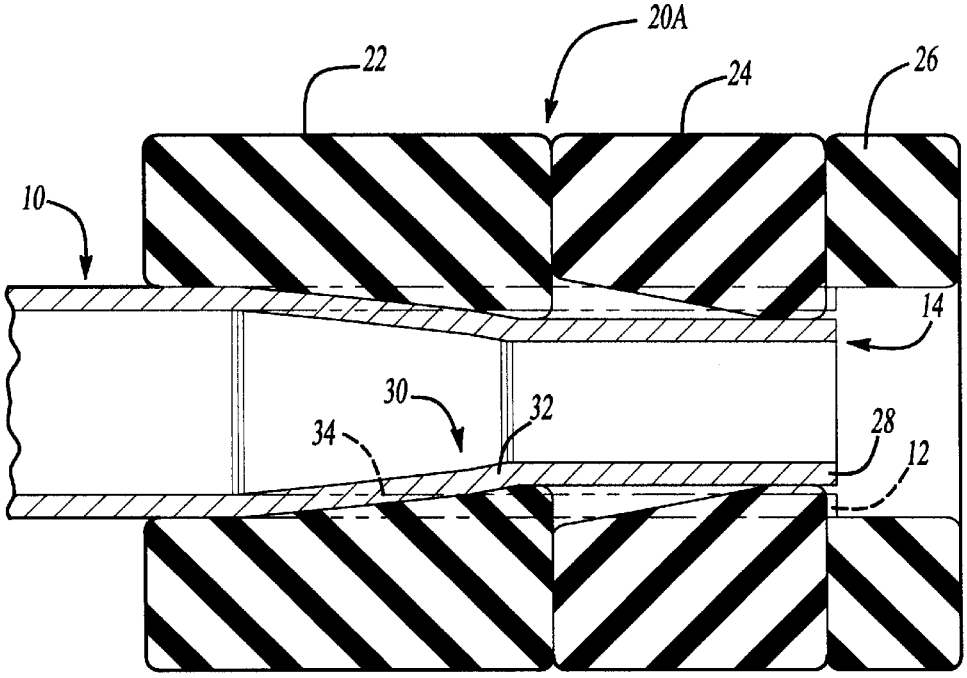
FIG. 2 is a sectional view of a preform die assembly according to the present invention receiving the tubular axle blank, the original shape of the tubular axle blank being shown in phantom.

The heater 21 heats the length 19 of the tubular blank 10 prior to the tubular blank 10 being received within the first or preform die assembly 20A (FIG. 2). The first length 19 is heated to a temperature less than 1500 degrees Fahrenheit, and preferably to a temperature of approximately 1250 degrees Fahrenheit. The 1250 degrees Fahrenheit temperature provides sufficient heating to allow effective material flow while maintaining columnar integrity of the tubular blank 10. Further, by heating the tubular blank 10 to a temperature less than the transformation temperature of steel (which occurs at approximately 1500 degrees Fahrenheit) the present invention allows the use of heat treated steel without loss of the heat treated properties. The present invention is similarly applied to non-heat treated steel but the steel must be subjected to a quench and temper operation after forming to obtain the desired strength for an axle.

FIG. 2 shows a sectional view of the tubular blank 10 inserted into the preform die assembly 20A. The preform die assembly 20A in the disclosed embodiment includes a preform die 22, a guide die 24 and a spacer 26. The preform die assembly 20A is forced onto the end 14 of the tubular blank 10. Although only one end 14 of the tubular blank 10 is shown being received into the preform die assembly 20A, it should be realized that both ends of the tubular blank 10 preferably undergo each operation simultaneously.

Preferably, the tubular blank 10 is held stationary as the machine 23 (FIG. 1) simultaneously forces the die assemblies onto both ends of the tubular blank 10. A die lubricant such as graphite provides proper lubrication for the axle as it is being formed. By using a lubricant and by performing a two stage forming operation, a mandrel is not required to be inserted into the tubular axle blank 10 during the forming. This eliminates the possibility of a mandrel being wedged into the tubular blank and the resultant scrap. Further, by making minor known forming die modifications and stroke length adjustments on the forming machine, material flow to the inside of the tubular axle blank 10 is readily controlled. An adequate amount of material is thereby provided for strength and a later machining operation.

An available force of approximately 300,000 pounds is necessary to complete the forming operation, however, the preform die assembly 20A is preferably pressed to a distance on the tubular blank 10. It should be realized that other force requirements may be required depending on the tubular blank diameter and wall thickness. By pressing to a distance, accuracy and consistency of material flow is further assured. Moreover, by changing the guide die 24 and the spacer 26, various machines can benefit from the present invention.

The preform die assembly 20A is forced onto the tubular blank 10, and the original diameter 12 (shown in phantom) is reduced to a second diameter 28 by the preform die 22. As the preform die assembly 20A is forced further onto the tubular blank 10 an intermediate section 30 is formed between the original diameter 12 and the second diameter 28 while the end 14 passes through the guide die 24 and the spacer 26. The guide die 24 maintains the axial alignment of the tubular blank 10 as it passes through the preform die 27. The spacer 26 axially locates the preform die 22 and the guide die 24. Preferably, the intermediate section 30 is formed as a first ramped section 32 and a second ramped section 34.

Figure 3:
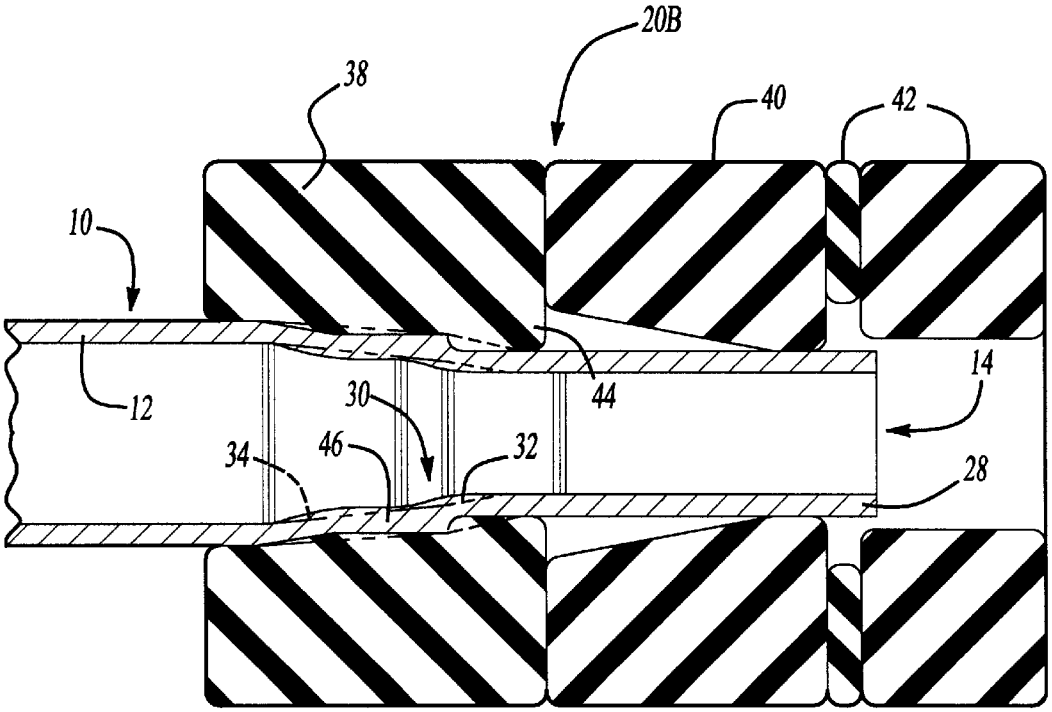
FIG. 3 is a sectional view of an upset die assembly according to the present invention receiving the tubular axle blank after being formed by the preform die assembly of FIG. 2, the previous shape of the tubular axle blank being shown in phantom.

FIG. 3 shows the tubular blank 10 inserted into a second or upset die assembly 20B. The tubular blank 10 as formed by the preform die assembly 20A is shown in phantom. The upset die assembly 20B in the disclosed embodiment includes an upset die 38, a guide die 40 and spacers 42. The upset die assembly 20B is forced onto the end 14 of the tubular blank 10 as described above to form the final bearing shoulder and spindle configuration.

As the upset die assembly 20B is forced onto the tubular blank 10 the second diameter 28 passes through the upset die 38 and the first ramped section 32 contacts a restricted portion 44 of the upset die 38. The restricted portion 44 reduces a portion of the first ramped section 32 (shown in phantom) to the second diameter 28 and forms a gathered material section 46 into the intermediate section 30. The spacers 42 locate the upset die 38 such that the gathered material section 46 is accurately positioned. Preferably, the gathered material area 46 is a substantially stepped section formed intermediate the first ramped section 32 (shown in phantom) and the second ramped section 34 (shown in phantom).

Figure 4:
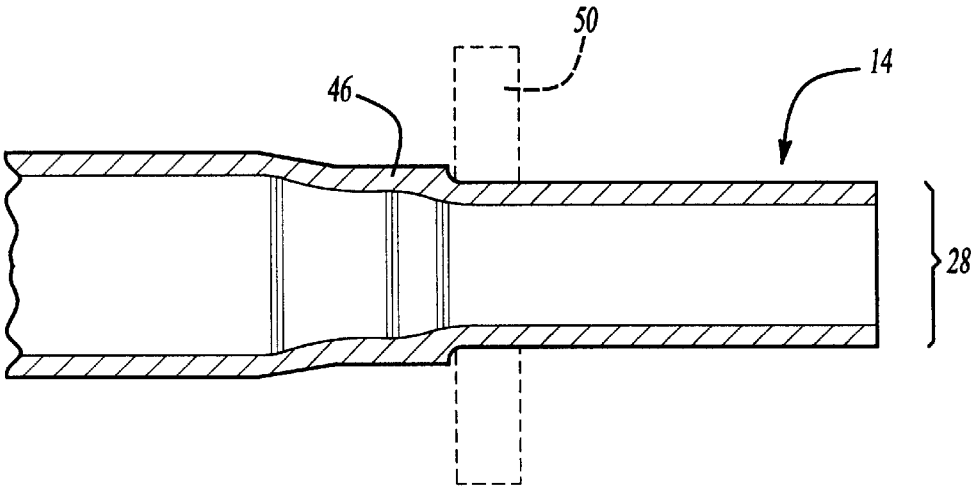
FIG. 4 is a general sectional view of the tubular axle blank after being formed according to the present invention.

The final form of an end 14 of the tubular axle bank 10 is shown in FIG. 4 after forming as described above. The final axle configuration is formed by a machining operation. The second diameter 28 provides a pre-machined diameter for the final axle spindle and the gathered material area 46 provides a pre-machined area for the final integral bearing shoulder. A bearing 50 is shown in phantom at the area where it will be mounted after the machining operation. A wheel nut is mounted on the bearing. The material quantity requirements for the relationship between a pre-machined section and a final machined section is well known and forms no part of the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A method of forming a tubular axle comprising:

(1) heating a first length of a tubular axle blank having an original diameter;

(2) forcing an end of said tubular axle blank into a first die, said first die reducing a second length of said tubular axle blank to a second diameter, said second diameter and said original diameter having an intermediate section formed therebetween; and (3) forcing said end of said tubular axle blank into a second die, said second die forming a gathered material section into said intermediate section.

2. The method according to claim 1, further comprising the step of lubricating said tubular axle blank prior to step 2 and step 3.

3. The method according to claim 1, wherein step 1 includes heating said first length of said tubular blank to a temperature less than 1500 degrees Fahrenheit.

4. The method according to claim 1, wherein step 1 includes heating said first length of said tubular blank to a temperature of approximately 1250 degrees Fahrenheit.

5. The method according to claim 1, wherein step 2 includes forming said intermediate section as a first ramped section and a second ramped section.

6. The method according to claim 5, wherein step 3 includes forming said gathered material section approximately intermediate said first ramped section and said second ramped section.

7. The method according to claim 1, wherein step 3 includes forming said gathered section as a substantially stepped section having a diameter intermediate said second diameter and said original diameter.

8. The method according to claim 1, wherein steps 2 and 3 are completed without a mandrel located within said tubular blank.

9. The method according to claim 1, wherein said method is performed on both ends of said tubular axle blank simultaneously.

10. A method of upset forming an integral spindle and axle collar into a tubular axle comprising:

(1) induction heating a first length of a tubular axle blank having an original diameter to a temperature less than 1500 degrees Fahrenheit;

(2) forcing an end of said tubular axle blank into a first die, said first die reducing a second length of said tubular axle blank to a second diameter, said second diameter and said original diameter having a substantially ramped section formed therebetween, said ramped section formed as a first ramped section and a second ramped section; and (3) forcing said end of said tubular axle blank into a second die, said second die reducing a portion of said ramped section to said second diameter and forming a substantially stepped section into said ramped section, said stepped section having a diameter intermediate said second diameter and said original diameter.

11. The method according to claim 10, further comprising the step of lubricating said tubular axle blank prior to step 2 and step 3.

12. The method according to claim 10, wherein step 1 includes heating said first length of said tubular blank to a temperature of approximately 1250 degrees Fahrenheit.

13. The method according to claim 10, wherein step 3 includes forming said gathered material section approximately intermediate said first ramped section and said second ramped section.

14. The method according to claim 10, wherein steps 2 and 3 are completed without a mandrel located within said tubular blank.

15. An apparatus for forming an integral spindle and axle collar into a tubular axle comprising:

an induction heater to heat a first length of a tubular axle blank having an original diameter;

a preform die which receives an end of said tubular axle blank, said preform die reducing a second length of said tubular axle blank to a second diameter and forming a substantially ramped section intermediate said second diameter and said original diameter; and a substantially stepped upset die which receives said end of said tubular axle blank and forms a substantially stepped section into said ramped section, said stepped section having a diameter intermediate said second diameter and said original diameter.

16. A method of forming a tubular axle comprising:

(1) heating a first length of a tubular axle blank having an original diameter to a temperature less than 1500 degrees Fahrenheit;

(2) forcing an end of said tubular axle blank into a first die, said first die reducing a second length of said tubular axle blank to a second diameter, said second diameter and said original diameter having an intermediate section formed therebetween; and (3) forcing said end of said tubular axle blank into a second die, said second die forming a gathered material section into said intermediate section.

17. The method according to claim 16, wherein step 1 includes heating said first length of said tubular blank to a temperature of approximately 1250 degrees Fahrenheit.

* * * * *